US008459899B2

(12) United States Patent
Pujol Artigas

(10) Patent No.: US 8,459,899 B2
(45) Date of Patent: Jun. 11, 2013

(54) VIBRATING APPARATUS FOR COMPACTING CONCRETE

(75) Inventor: José Maria Pujol Artigas, Barcelona (ES)

(73) Assignee: Industrias Technoflex, S.A., Rubi (Barcelona) (ES)

( * ) Notice: Subject to any disclaimer, the term of this patent is extended or adjusted under 35 U.S.C. 154(b) by 8 days.

(21) Appl. No.: 13/324,059

(22) Filed: Dec. 13, 2011

(65) Prior Publication Data

US 2012/0308304 A1 Dec. 6, 2012

(30) Foreign Application Priority Data

Dec. 15, 2010 (ES) ..... 201001229 U

(51) Int. Cl.
*B01F 11/04* (2006.01)

(52) U.S. Cl.
USPC ..... 404/113; 366/116; 366/120

(58) Field of Classification Search
USPC ..... 404/84.05, 113; 366/116, 120
See application file for complete search history.

(56) References Cited

U.S. PATENT DOCUMENTS

| | | | | |
|---|---|---|---|---|
| 5,202,612 | A * | 4/1993 | Yoshida et al. | 318/400.01 |
| 6,015,225 | A * | 1/2000 | Williams | 366/6 |
| 6,394,639 | B2 * | 5/2002 | Lindley | 366/121 |
| 6,619,832 | B1 * | 9/2003 | Steffen | 366/120 |
| 6,808,384 | B1 * | 10/2004 | Jordan et al. | 425/432 |
| 2008/0316853 | A1 * | 12/2008 | Steffen | 366/60 |

FOREIGN PATENT DOCUMENTS

| | | | |
|---|---|---|---|
| EP | 1316655 | A1 | 6/2003 |
| WO | 00/56999 | A1 | 9/2000 |

* cited by examiner

*Primary Examiner* — Gary Hartmann
(74) *Attorney, Agent, or Firm* — Hess Patent Law Firm LLC; Robert J. Hess

(57) ABSTRACT

Vibrating apparatus (50) for compacting concrete that includes a vibrating head (1) with an electric motor (11) operating a vibration generating device (10), a current conductor wiring (12*a*, 12*b*, 12*c*) with a plug (13) for connecting said electric motor (11) to a electric supply network (27), a frequency converter (30) for converting the frequency of the current supplied by the electric supply network to another different frequency, and a control unit (2) having a switch (14), a plurality of sensors (28) for detecting different operating parameters of the vibrating apparatus, a programmable electronic circuit (15) for monitoring said parameters from signals supplied by the sensors, a memory (16) for storing representative data of the parameters and a communications management device (17) whereby a user accesses the data stored in the memory (16).

9 Claims, 3 Drawing Sheets

VIBRATING APPARATUS FOR COMPACTING CONCRETE

FIELD OF THE ART

The present invention generally relates to a vibrating apparatus for compacting concrete, and more particularly to a vibrating apparatus for compacting concrete provided with a control unit with a programmable electronic circuit and a memory where representative data of different operating parameters of the apparatus are stored, which can be consulted from the outside to assist in apparatus controlling, maintaining and repairing tasks.

BACKGROUND OF THE INVENTION

Document EP-A-1316655 describes a vibrating apparatus for compacting concrete comprising a vibrating head with a vibration generating device and an electric motor operating said vibration generating device, a current conductor wiring with a plug for connecting said electric motor to an electric supply network, a frequency converter connected to said current conductor wiring for converting the frequency of the current supplied by said electric supply network to another different frequency; and a control unit comprising a switch connected to said current conductor wiring for starting and stopping the motor. The frequency converter and the control unit are housed in different casings and attached by a relatively long section of the current conductor wiring, with the frequency converter located relatively close to the plug and the control unit located relatively close to the vibrating head.

Such vibrating apparatuses require specific conditions for proper operation, and they are often commercialized under a warranty conditioned by the use in the specific conditions. When a client makes a complaint due to the apparatus failure during the warranty period, the manufacturer does not have instruments for determining if the failure has been due to improper use, in which case the client would lose the warranty, or if it has been otherwise due to a defect of the apparatus. Likewise, in case of any breakdown, the mechanic also does not have instruments for knowing under what conditions the latter has occurred.

Document EP-A-1163409 describes how to monitor different parameters of a vibrator for concrete, such as the temperatures of the winding of the motor, the casing of the vibrating head containing the electric motor, the frequency converters, the electrical wiring and a protective tube thereof, for detecting possible short-circuits, earth faults, and earth currents, for which the apparatus uses a suitable electronic circuit associated with the frequency converters. When parameters outside a range of predetermined values are detected, the electronic circuit cuts the current supply. A drawback of this apparatus is that it does not incorporate a memory associated with the electronic circuit for storing representative data of different operating parameters of the apparatus such that these data can be subsequently consulted.

DESCRIPTION OF THE INVENTION

The present invention aims to solve the foregoing and other drawbacks by providing a vibrating apparatus for compacting concrete of the type comprising a vibrating head which includes a vibration generating device and an electric motor operating said vibration generating device, a current conductor wiring with a plug for connecting said electric motor to an electric supply network, a frequency converter connected to said current conductor wiring for converting the frequency of the current supplied by said electric supply network to another different frequency, and a control unit comprising at least one switch connected to said current conductor wiring and a plurality of sensors for detecting different operating parameters of the vibrating apparatus. The vibrating apparatus of the present invention is characterized in that said control unit further includes a programmable electronic circuit for monitoring said parameters from signals supplied by said sensors, a memory in connection with said programmable electronic circuit for storing representative data of said parameters and a communications management device in connection with said programmable electronic circuit, whereby a user accesses said data stored in said memory.

The mentioned communications management device preferably comprises one or more two-way connection ports configured for receiving the connection of a conventional computer or of a dedicated console whereby the data stored in the memory can be read and/or the programmable electronic circuit can be reprogrammed. Preferably, the communications management device further comprises a wireless connection device for connecting to a communications network, such as the Internet or the like, through which a user provided with a computer connected to the network can remotely read the data stored in the memory and/or reprogram the programmable electronic circuit.

In one embodiment, the control unit further includes a display screen and a keyboard in connection with said programmable electronic circuit whereby a user can also read the data stored in the memory and/or reprogram the programmable electronic circuit.

The mentioned parameters which are stored in the memory can be, for example, the accumulated operating time of the frequency converter, the accumulated operating time of the motor, and currents and/or voltages and/or temperatures at which different elements of the vibrating apparatus have been operating at different times. Preferably, the programmable electronic circuit is programmed for emitting different alarms when the values corresponding to one or more of said parameters detected by the mentioned sensors are outside a range of predetermined values. In such case, among the parameters which are stored in the memory and which can be subsequently consulted further include times at which the different alarms have been emitted, and the current and/or voltage and/or temperature in the element that has emitted the alarm at the time of each alarm. Other parameters such as the serial number and manufacturing date of the vibrating apparatus can also be entered into the memory when the programmable electronic circuit is programmed or reprogrammed by means of a computer or a console.

Preferably, the control unit includes an energy storage device, such as for example a battery, connected for keeping the programmable electronic circuit, including a clock associated therewith, and the memory active when the plug of the vibratory apparatus is disconnected from the electric supply network.

In general, the accumulated operating time of the frequency converter cannot be set to zero, and other parameters, such as for example the accumulated operating time of the motor, can only be set to zero upon entering a password. The parameters can be read from the memory of a vibrating apparatus by using a console, for example, and saved in the console memory, and subsequently these parameters can be dumped into the memory of a plurality of other vibrating apparatuses.

Thus the vibrating apparatus of the present invention provides a valuable instrument for programming the maintenance and diagnosing breakdowns, being able to determine whether a particular breakdown has occurred due to an improper use of the apparatus or due to a defect thereof.

The vibrating apparatus of the present invention comprises three independent sealed casings. The control unit is housed in a control casing, the vibrating head is housed in a head casing, and the frequency converter is housed in a converter casing.

BRIEF DESCRIPTION OF THE DRAWINGS

The foregoing and other features and advantages will be more fully understood from the following detailed description of an embodiment with reference to the attached drawings, in which.

DETAILED DESCRIPTION OF EXEMPLARY EMBODIMENTS

Figure 1:
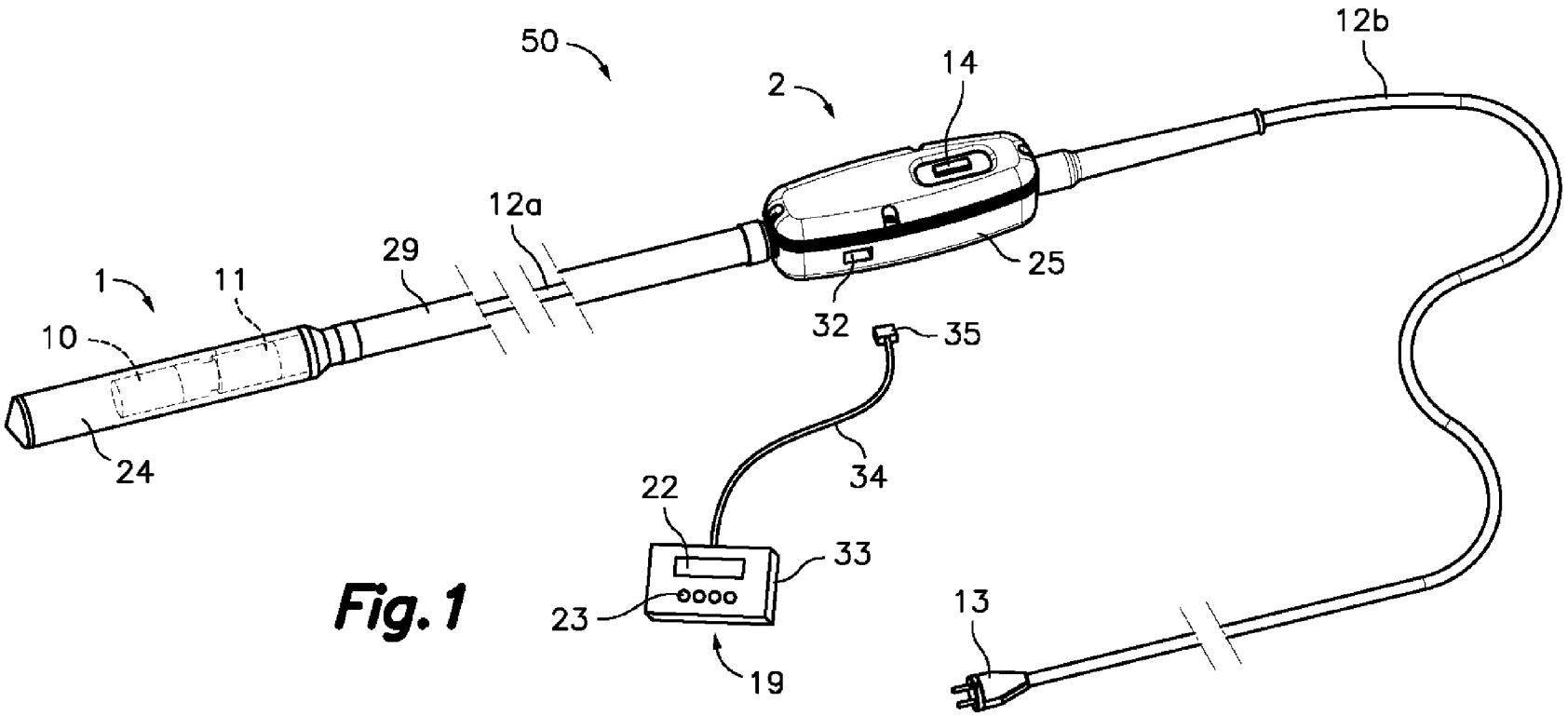
FIG. 1 is a perspective view of a vibrating apparatus for compacting concrete according to a first embodiment of the present invention.
Figure 2:
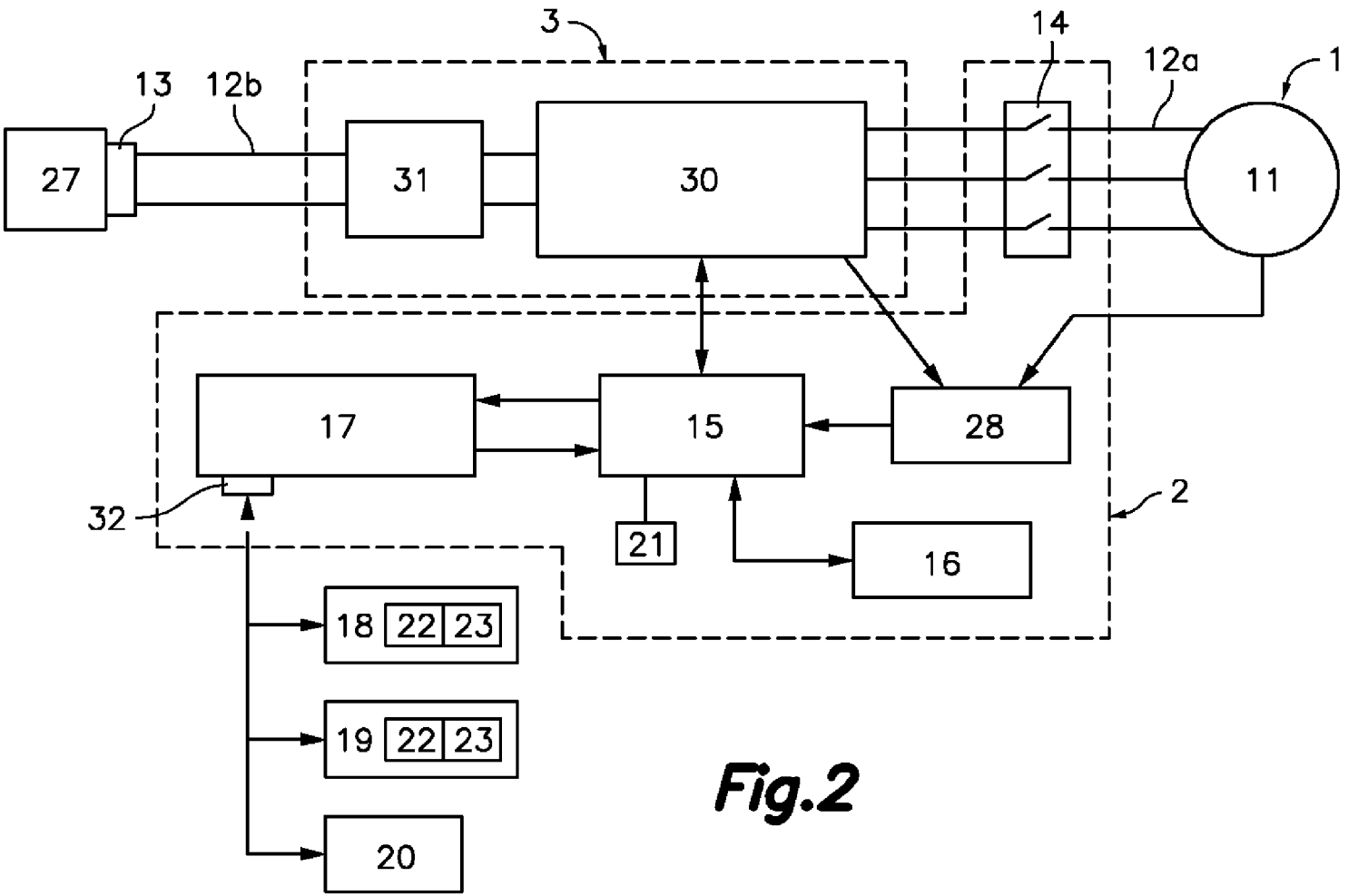
FIG. 2 is a diagram of the electric, electronics and control system of the apparatus of FIG. 1.

First, referring to FIGS. 1 and 2, a vibrating apparatus for compacting concrete according to a first embodiment of the present invention is designated in general with the reference numeral 50, which comprises a vibrating head 1 provided with a head casing 24 in which there is housed a vibration generating device 10 and an electric motor 11 operatively connected for operating said vibration generating device 10. The vibrating apparatus 50 includes an insulated current conductor wiring 12*a*, 12*b*, provided with a plug 13 for connecting said electric motor 11 to an electric supply network 27 (see FIG. 2).

The vibrating apparatus 50 also comprises a control casing 25 in which there is housed a frequency converter 30 connected to said current conductor wiring 12*a*, 12*b* for converting the frequency of the current supplied by said electric supply network 27 to another generally higher different frequency, and a control unit 2 comprising a switch 14 connected to said current conductor wiring 12*a*, 12*b* for starting and stopping the electric motor 11.

In the illustrated embodiment, the head casing 24 is located relatively close to the control casing 25 and connected thereto by a relatively short first section 12*a* of the current conductor wiring which, together with the vibrating head 1, is submergible in the fresh concrete mass. To that end, this first section 12*a* of the current conductor wiring is covered by a sealed and flexible protective sheathing 29, and the head casing 24 is leak-tight.

The control casing 25 and the plug 13 are connected by a relatively long second section 12*b* of the current conductor wiring, such that the control casing 25 can be manually held for managing and controlling the control head 1 without said second section 12*b* of the current conductor wiring limiting its movement. Preferably, the control casing 25 and its connection with the second section 12*b* of the current conductor wiring are also leak-tight.

In FIG. 1 there are depicted interruptions in the protective sheathing 29 and in the first and second sections 12*a*, 12*b* of the current conductor wiring symbolizing a variable length thereof, generally longer than that shown.

Now referring to FIG. 2, in the current conductor wiring 12*a*, 12*b* between the plug 13 and the electric motor 11 there are intercalated a power unit 3 including a radio frequency interference (RFI) filter 31 for eliminating noise from the electric supply network 27 and the mentioned frequency converter 30, which can be configured, for example, for converting the 50 Hz two-phase current of the electric supply network 27 into a high-frequency, for example 200 Hz, three-phase current, for supplying the electric motor 11. Between the frequency converter 30 and the electric motor 11 there is intercalated the switch 14 which can be a manually operated switch or a switch controlled through a programmable electronic circuit 15.

The control unit 2 includes a plurality of sensors 28 (generically depicted by a single rectangle in FIG. 2), distributed for example in the head casing 24, in the control casing 25, in the plug 13 and/or other places of the vibrating apparatus 50 for detecting different operating parameters of the vibrating apparatus 50, the mentioned programmable electronic circuit 15 for monitoring said parameters from the signals supplied by said sensors 28, and a memory 16 for storing representative data of said parameters. The programmable electronic circuit 15 can advantageously be programmed for emitting different alarms when the values of one or more of said parameters detected by said sensors are outside a range of predetermined values.

Preferably, the control unit 2 includes an energy storage device 21 connected for keeping the programmable electronic circuit 15, including a clock associated therewith, and the memory 16 active when the plug 13 of the vibratory apparatus is disconnected from the electric supply network 27. This allows storing in the memory 16 the parameters registered in a time frame. Said energy storage device 21 can be a rechargeable battery or a disposable battery.

An important feature of the vibrating apparatus of the present invention is a communications management device 17, which is integrated into the control unit 2 and in communication with the programmable electronic circuit 15, and which allows a user to access said data stored in said memory 16 in different forms.

In an embodiment, the mentioned communications management device 17 comprises a two-way connection port 32, such as a USB port, integrated in the control casing 25 (also see FIG. 1), whereby a computer 18 or a console 19 can be connected to the programmable electronic circuit 15 for reading the data stored in the memory 16 and/or reprogramming the programmable electronic circuit 15. FIG. 1 shows said console 19, which comprises a casing 33 housing programmable electronic control means, a display screen 22 and a keyboard 23 in connection with said electronic control means, and a connection cable 34 ending in a connector 35 configured to be connected to the two-way connection port 32 of the control casing 25.

Thus by means of the console 19 and by using its display screen 22 and its keyboard 23, a user can read the data stored in the memory 16 and/or reprogram the programmable electronic circuit 15. Similar operations can alternatively be performed using the mentioned computer 18, which is preferably a laptop or the like provided with a display screen 22 and a keyboard 23 (FIG. 2).

Additionally or alternatively the communications management device 17 can comprise a wireless connection device 20 for connecting to a communications network, such as the Internet or the like, through which a user remotely connected by means of a computer or the like can read the data stored in the memory 16 and/or reprogram the programmable electronic circuit 15. This wireless connection device 20 can be an external component connected through the two-way connection port 32, as shown in FIG. 2, or alternatively an internal component integrated in the communications management device 17.

Preferably, the parameters which are stored in the memory 16 include the accumulated operating time of the frequency converter 30, which cannot be set to zero by any means, and the accumulated operating time of the motor 10, which can be set to zero if a password identifying the user had been previously entered. Other parameters being able to be conveniently stored in the memory 16 are, for example, current, voltage and temperature values at which different elements of the vibrating apparatus have been operating at different times. If the programmable electronic circuit 15 is programmed for emitting alarms, the parameters stored in the memory 16 can further comprise the times at which the different alarms have been emitted, and the current, voltage and/or temperature at the time of each alarm.

In the vibrating apparatus 50 of the first embodiment shown in FIGS. 1 and 2, both the control unit 2 and the power unit 3 are housed in the control casing 25.

Figure 3:
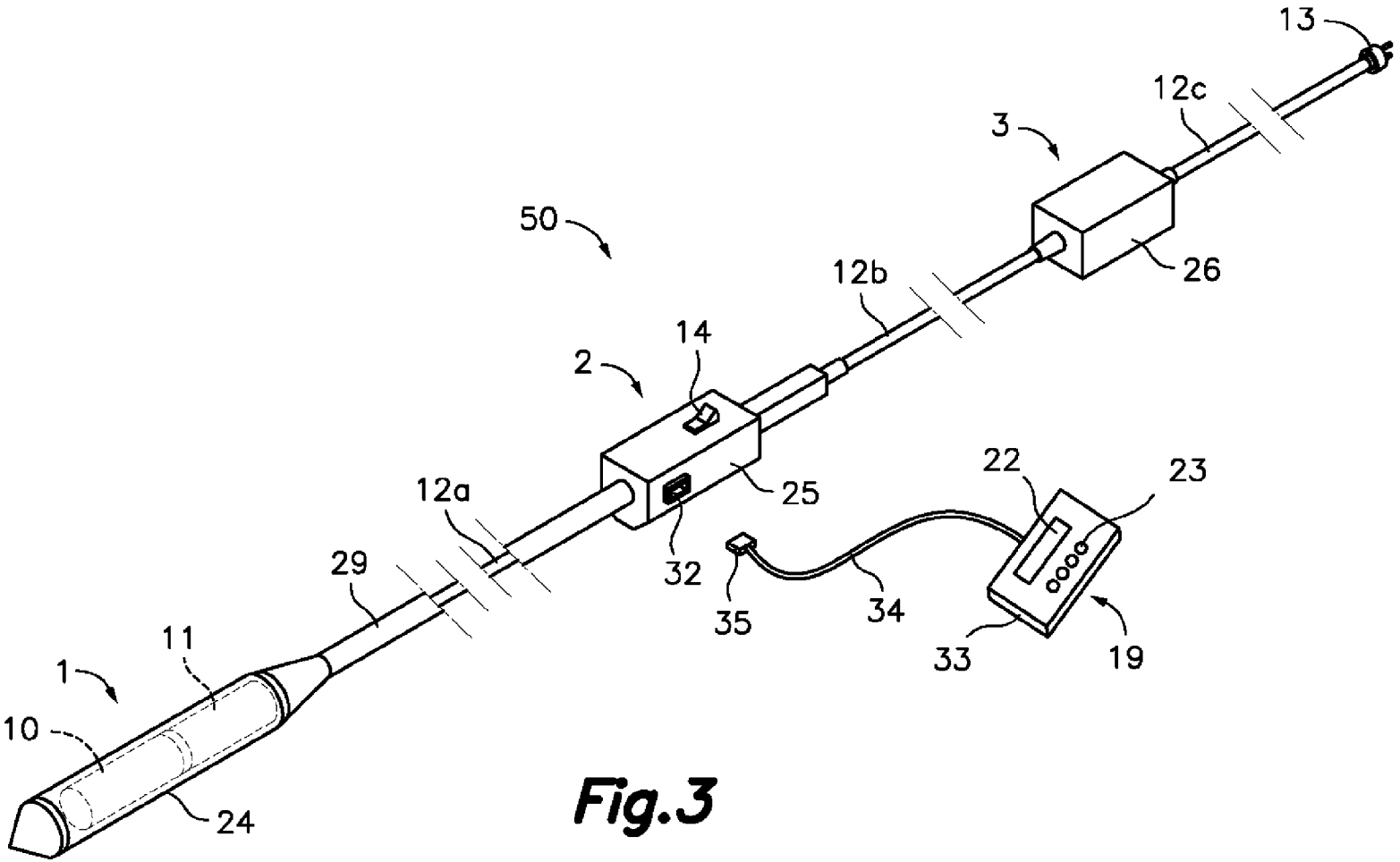
FIG. 3 is a perspective view of a vibrating apparatus for compacting concrete according to a second embodiment of the present invention.

FIG. 3 shows a second embodiment of the vibrating apparatus 50 of the present invention, which is essentially similar to the first embodiment except herein the frequency converter 30 is housed in a converter casing 26 connected to the current conductor wiring between the control casing 25 and the plug 13. In this case the second section 12*b* of the current conductor wiring connects the control casing 25 with said converter casing 26, and a third section 12*c* of the current conductor wiring connects the converter casing 26 and the plug 13. Preferably, the control casing 25, the converter casing 26 and their connections with the second and third sections 12*b*, 12*c* of the current conductor wiring are leak-tight.

Optionally, the converter casing 26 can house a radio frequency interference (RFI) filter 31 in connection with the current conductor wiring 12*a*, 12*b*, 12*c*. The frequency converter 30 and said radio frequency interference (RFI) filter 31 form a power unit 3 as in FIG. 2.

The vibrating apparatus 50 of the second embodiment is also similar to that of the first embodiment, and comprises a vibrating head 1 provided with a head casing 24 in which there is housed a vibration generating device 10 and an electric motor 11, a control casing 25 connected to the head casing 24 by a first section 12*a* of the current conductor wiring covered by a sealed and flexible protective sheathing 29. The control casing 25 houses a control unit 2 similar to that previously described in relation with FIG. 2, and comprises a switch 14 connected to said current conductor wiring 12*a*, 12*b*, 12*c*, and a two-way connection port 32 for connecting to a computer 18 or a console 19.

FIG. 3 further shows by way of example the mentioned console 19, which comprises a casing 33 housing programmable electronic control means, a display screen 22, a keyboard 23, and a connection cable 34 ending in a connector 35 configured to be connected to the two-way connection port 32 of the control casing 25.

Variations and modifications with respect to the embodiment shown and described will readily occur to a person skilled in the art without departing from the scope of the present invention as defined in the attached claims.

What is claimed is:

1. A vibrating apparatus for compacting concrete of the type comprising a vibrating head which includes a vibration generating device and an electric motor operating said vibration generating device;

a current conductor wiring with a plug for connecting said electric motor to an electric supply network;

a frequency converter connected to said current conductor wiring for converting the frequency of the current supplied by said electric supply network to another different frequency; and a control unit comprising at least one switch connected to said current conductor wiring and a plurality of sensors for detecting different operating parameters of the vibrating apparatus;

characterized in that said control unit further includes:

a programmable electronic circuit for monitoring said parameters from signals supplied by said sensors;

a memory for storing representative data of said parameters; and a communications management device whereby a user accesses said data stored in said memory.

2. The vibrating apparatus according to claim 1, characterized in that said communications management device comprises a two-way connection port configured for receiving the connection of a computer or of a console whereby the data stored in the memory are read and/or the programmable electronic circuit is reprogrammed.

3. The vibrating apparatus according to claim 1, characterized in that said communications management device comprises a wireless connection device for connecting to a communications network through which the data stored in the memory are read and/or the programmable electronic circuit is reprogrammed.

4. The vibrating apparatus according to claim 1, characterized in that the control unit further includes a display screen and a keyboard in connection with said programmable electronic circuit whereby the data stored in the memory are read and/or the programmable electronic circuit is reprogrammed.

5. The vibrating apparatus according to claim 1, characterized in that said parameters stored in the memory are selected from a group comprising the accumulated operating time of the frequency converter, the accumulated operating time of the motor, and currents and/or voltages and/or temperatures at which different elements of the vibrating apparatus have been operating at different times.

6. The vibrating apparatus according to claim 5, characterized in that said programmable electronic circuit is programmed for emitting different alarms when the values of one or more of said parameters detected by said sensors are outside a range of predetermined values.

7. The vibrating apparatus according to claim 6, characterized in that said group of parameters stored in the memory further comprises the times at which the different alarms have been emitted, and the current and/or voltage and/or temperature at the time of each alarm.

8. The vibrating apparatus according to claim 1, characterized in that the control unit includes an energy storage device connected for maintaining the programmable electronic circuit, including a clock associated therewith, and the memory active when the plug of the vibratory apparatus is disconnected from the electric supply network.

9. The vibrating apparatus according to claim 1, characterized in that the control unit is housed in a control casing independent of a head casing in which the vibrating head is housed and of a converter casing in which the frequency converter is housed.

* * * * *